US006962508B2

(12) United States Patent
Fang et al.

(10) Patent No.: US 6,962,508 B2
(45) Date of Patent: Nov. 8, 2005

(54) CARD CONNECTOR

(75) Inventors: HeSheng Fang, Kunsan (CN); Guohua Zhang, Kunsan (CN); ZiQiang Zhu, KUnsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/001,858

(22) Filed: Dec. 1, 2004

(65) Prior Publication Data

US 2005/0142949 A1 Jun. 30, 2005

(30) Foreign Application Priority Data

Dec. 25, 2003 (CN) ..... 2003201235660

(51) Int. Cl.[7] ..... H01R 23/70
(52) U.S. Cl. ..... 439/630; 439/260; 439/64
(58) Field of Search ..... 439/62, 64, 260, 439/630

(56) References Cited

U.S. PATENT DOCUMENTS 5,161,992 A * 11/1992 Birch ..... 439/260
5,775,949 A * 7/1998 Bricaud et al. ..... 439/630
5,997,356 A * 12/1999 Chang ..... 439/630
6,126,486 A 10/2000 Chang
6,655,590 B1 * 12/2003 McFeely et al. ..... 235/451

* cited by examiner

*Primary Examiner*—Tho D. Ta
*Assistant Examiner*—James R. Harvey
(74) *Attorney, Agent, or Firm*—Wei Te Chung

(57) ABSTRACT

An electrical card connector (100) for electrically connecting an electrical card with a printed circuit board includes an integral molded insulative housing (1) with a plurality of passageways (17) and a plurality of conductive contacts (2) received in the passageways. Each contact includes a main body (21), a contacting portion (22) for electrically contacting with the card, and a soldering portion (23) for soldering the electrical card connector to the printed circuit board. The integral insulative housing further includes a base member. The passageways are defined in the base member.

10 Claims, 6 Drawing Sheets

CARD CONNECTOR

BACKGROUND OF THE INVENTION

1. Field of the Invention

This invention generally relates to an electrical connector and more particularly, to an electrical card connector for a portable electronic appliance.

2. Description of the Prior Art

Conventional electrical card connector used in portable electronic devices for connecting an electrical card to a printed circuit board includes an insulative housing, a plurality of electrodes or contacts exposed in the housing for electrically connecting with circuit traces of the card and a card-protecting shell permitting the card to insert and remove therefrom and preventing the card from any exterior hazards. U.S. Pat. No. 6,126,486 discloses a card connector including an insulative housing and a plurality of terminals received in the housing. The insulative housing includes a plurality of passageways for receiving the terminals. Each terminal includes a soldering portion extending beyond a bottom surface of the passageway for soldering the card connector to the printed circuit board and a contacting portion projecting beyond a top surface of the housing for contacting with the electrical card and a fixing portion for securely fixing the terminal in the housing. However, the insulative housing includes a top frame and a bottom frame, therefore increasing product process and product cost. At the same time, the assembly process becomes relatively complex.

Hence, an improved card connector is desired to overcome the foregoing shortcomings.

BRIEF SUMMARY OF THE INVENTION

It is an object of the present invention to provide a card connector having a simple structure.

In order to attain the object above, an electrical card connector for electrically connecting an electrical card with a printed circuit board includes an integral molded insulative housing with a plurality of passageways and a plurality of conductive contacts received in the passageways. Each contact includes a main body, a contacting portion for electrically contacting with the card, a soldering portion for soldering the electrical card connector to the printed circuit board. The integral insulative housing further includes a base member. The passageways are defined in the base member.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
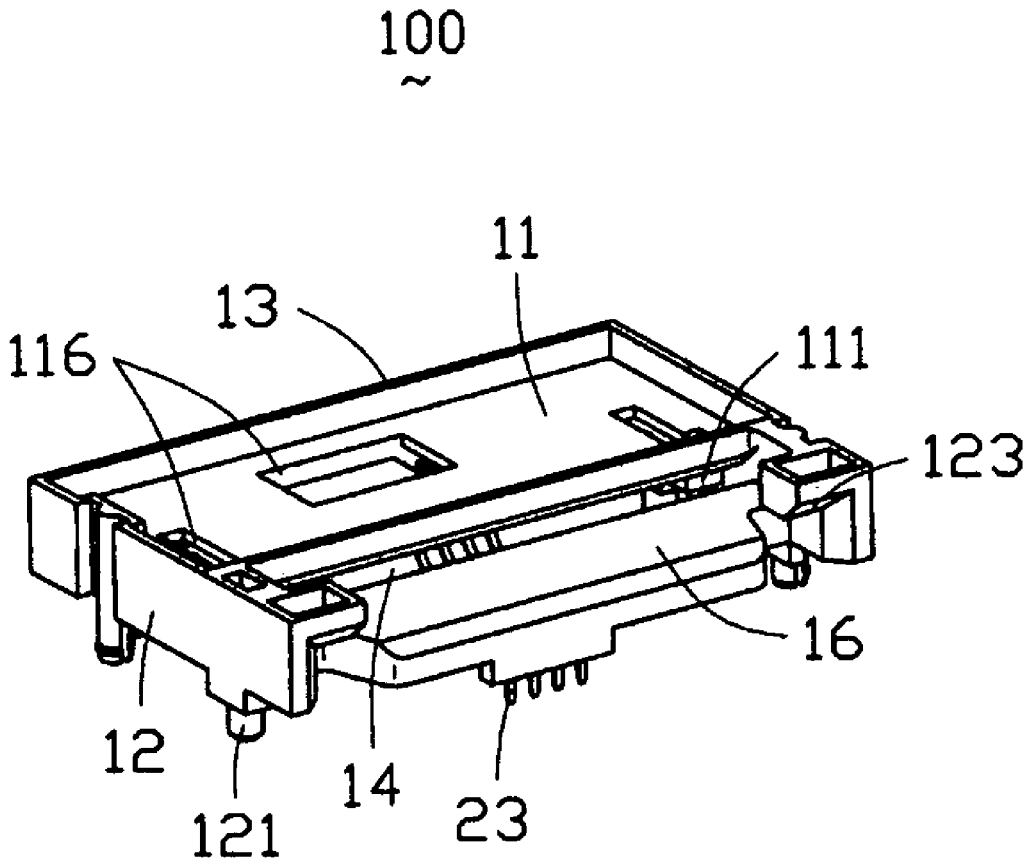
FIG. 1 is a perspective view of an electrical card connector according to the present invention.
Figure 2:
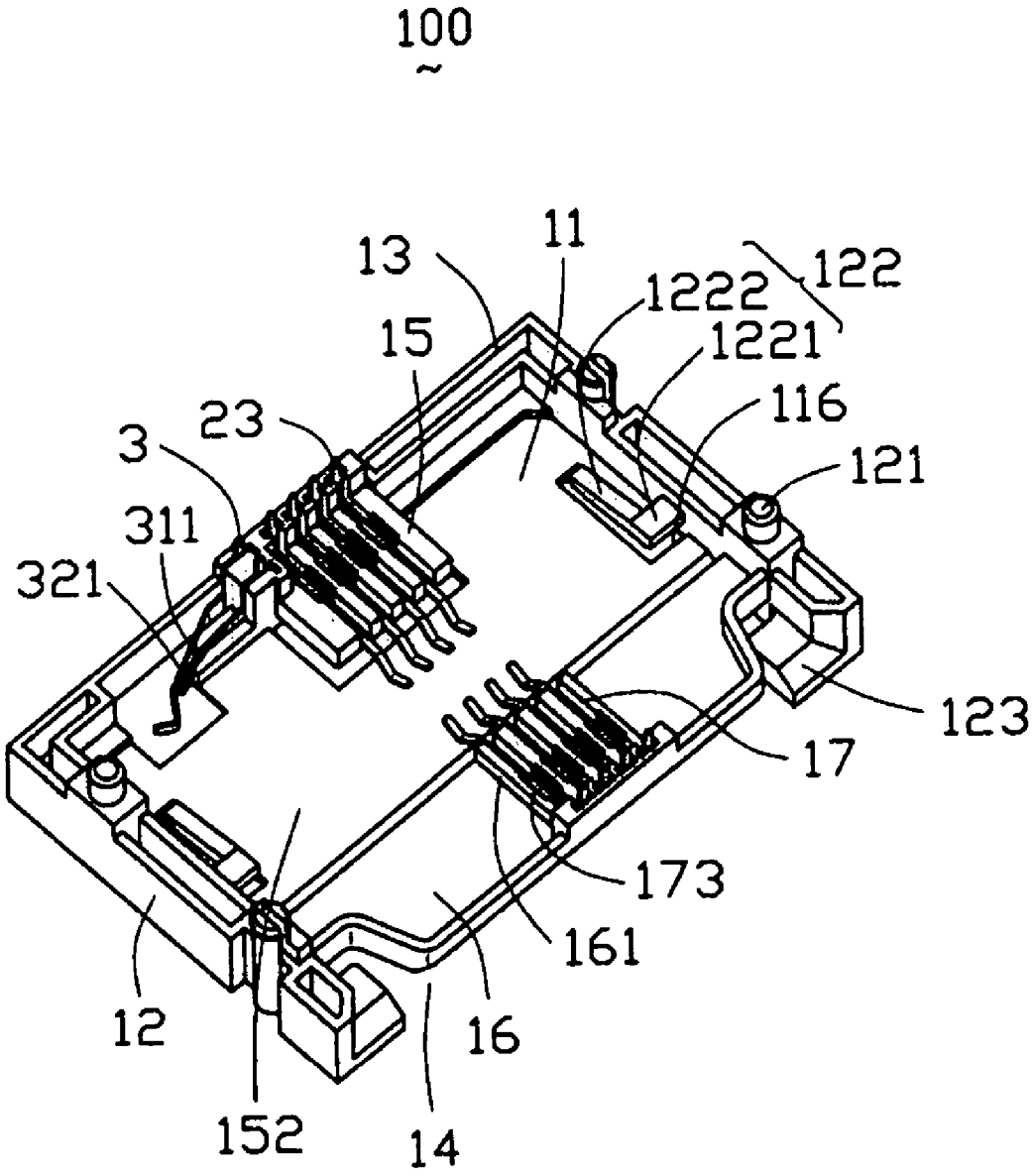
FIG. 2 is a similar view to FIG. 1, but taken from another perspective.

Referring to FIGS. 1–6, an electrical card connector 100 according to the present invention is provided for electrically connecting an electrical card 4 with a printed circuit board (not shown) and includes a substantially rectangular insulative housing 1, two opposite rows alignment conductive contacts 2 supported by the housing 1 and a pair of detective contacts 3 to detect the presence or absence of the inserted card 4.

Figure 3:
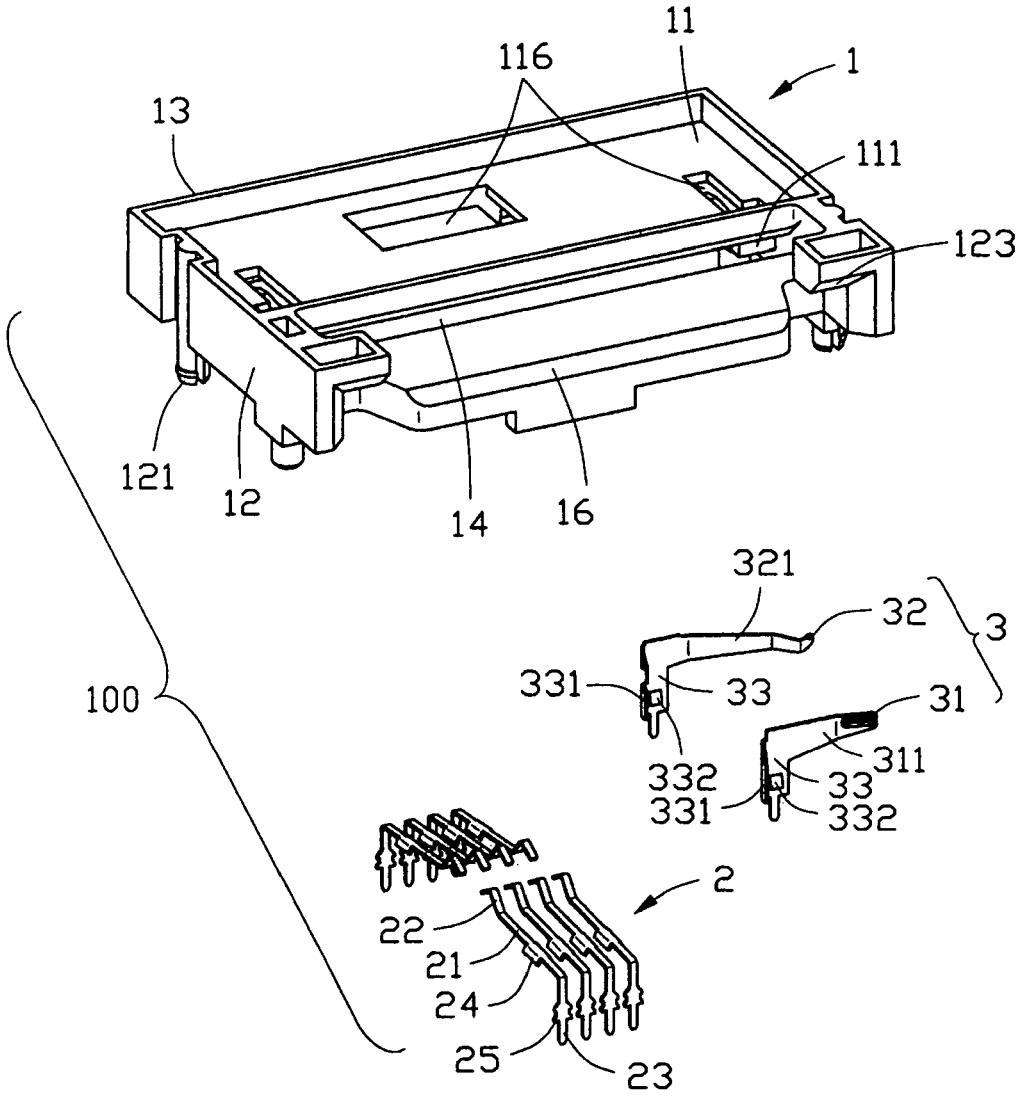
FIG. 3 is an exploded view of the electrical card connector.
Figure 4:
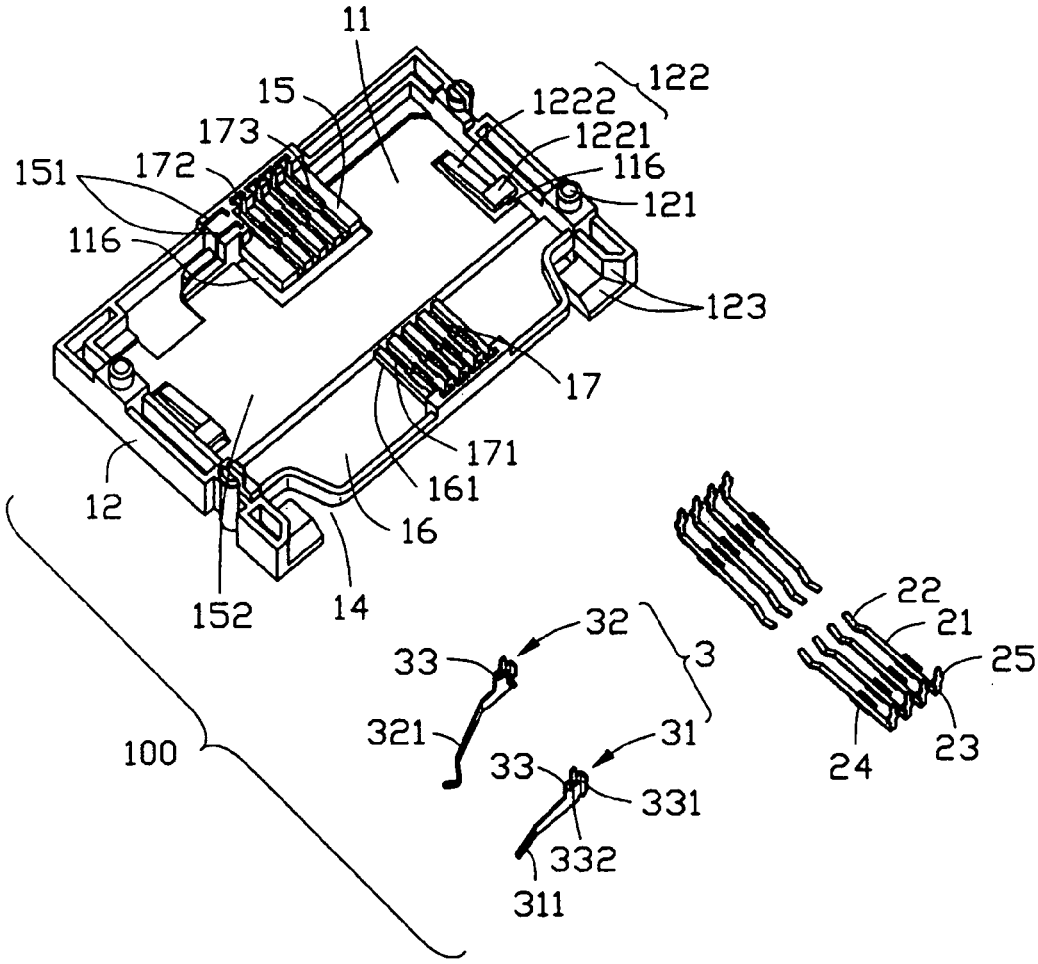
FIG. 4 is a similar view to FIG. 3, but taken from another perspective.
Figure 5:
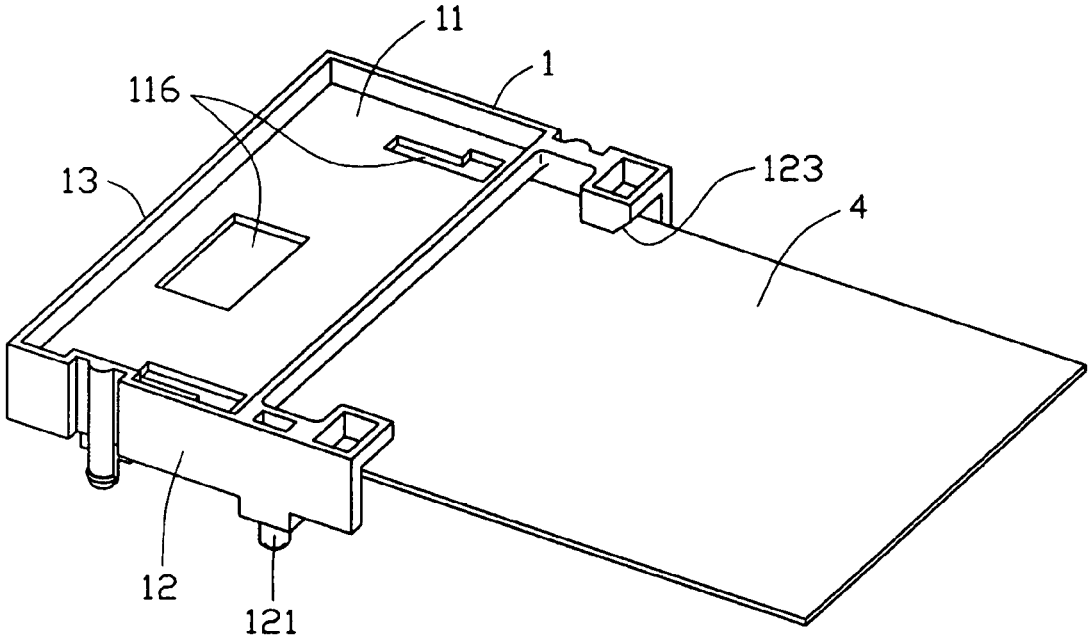
FIG. 5 is a perspective view of the electrical card connector, with an electrical card being inserted therein.
Figure 6:
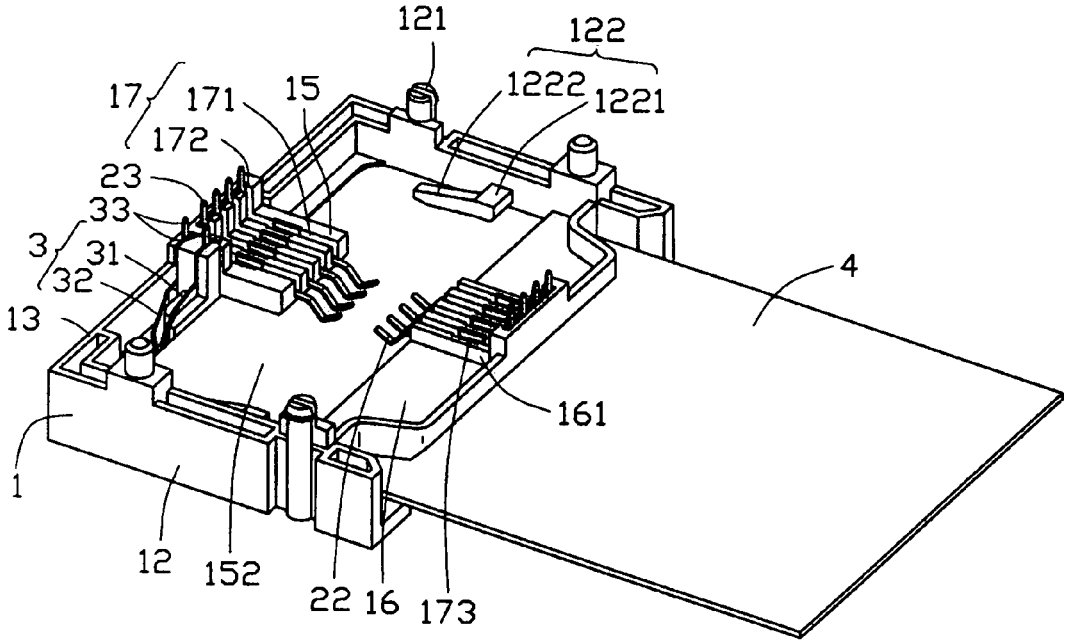
FIG. 6 is a similar view to FIG. 5, but taken from another perspective.

Referring to FIGS. 3–5, the insulative housing 1 includes a top wall 11, side walls 12 and a rear wall 13. The housing 1 further includes a base member (not labeled) positioned below the top wall 11. As a result, the top wall and the base member cooperately define a receiving room 14 for receiving the conductive contacts 2. The base member includes a first projecting board 15 forwardly extending from the rear wall 13 and a transverse support bar 16 spanning a front portion of the side walls 12. A second projecting board 161 is formed in a substantially middle portion of the transverse support bar 16. The first projecting board 15 is spaced from the second projecting board 161 by an air gap 152. The first and second projecting board 15, 161 both defines a plurality of passageways 17 for retaining the conductive contacts 2. Each passageway 17 includes a longitudinal channel 171 and a vertical recess 172 with a substantially T-shaped cross section perpendicular to the transverse channel 171. The longitudinal channel 171 includes a pair of side recesses 173 outwardly extending from side surfaces thereof. Each side wall 12 includes a locking portion 121 downwardly projecting from a bottom surface thereof for mounting the card connector 100 to the printed circuit board. A pair of beams 122 are disposed in substantially middle portions of the side walls 12 and project inwardly into the receiving room 14. Each beam 122 comprises an inwardly projecting post 1221 integrally and perpendicularly connecting with a corresponding side wall 12 and a spring arm 1222 slant and upwardly and rearward extending from the post 1221. The post 1221 is adjacent to the bar 16 and the spring arm 1222 is adjacent to the first projecting board 15. The insulative housing 1 defines a plurality of guiding chaffers 123 defined in the top wall 11 and the base member for facilitately inserting the electrical card 4 into the receiving room 14. In addition, the first projecting board 15 defines a pair of spaced slots 151 for receiving the detective contacts 3. The top wall 11 further defines a plurality of openings 116 for appropriately exposing the first projecting board 15 and the beams 122.

Referring to FIGS. 3–4, each conductive contact 2 is fixed in a corresponding passageway 17 and includes a main body 21 fixed in the transverse channel 171, a contacting portion 22 upwardly bent and extending from an end of the main body 21 for electrically connecting with the electrical card 4, a soldering portion 23 downwardly extending from another end of the main body 21 for connecting with the printed circuit board. The main body 21 includes a pair of tabs 24 downwardly extending from opposed sides thereof to abut against the side recesses 173 of the transverse channel 171. The soldering portion 23 includes a pair of barbs 25 transversely extending from opposed sides thereof for securely engaging with the vertical recesses 172 of the passageway 17.

Referring to FIGS. 3–4, the detective contacts 3 are fixed in corresponding slots 151 of the first projecting board 15 and consist of a first detective contact 31 and a second detective contact 32. Each detective contact 3 includes a fixing portion 33 for engaging with the L-shaped slot 151. The fixing portion 33 includes a flange 331 and a protrusion 332. The first detective contact 31 includes a first finger 311 connecting with the fixing portion 33, while the second detective contact 32 includes a second finger 321 connecting with the fixing portion 33.

Referring to FIGS. 3–6, in assembly, the conductive contacts 2 are assembled into the passageways 17 from the bottom surface of the electrical card connector 100. The tabs 24 of the main body 21 of the conductive contact 2 are received in the side recesses 173 of the housing 1. The barbs 25 of each conductive contact 2 engage with the vertical recesses 172 of corresponding passageway 17, thereby securely fixing the conductive contacts 2 in the passageways 17. The contacting portion 22 of each conductive contact 2 extends beyond corresponding receiving passageway 17 and projects into the air gap 152 for electrically connecting with the inserted electrical card 4. The soldering portion 23 of each conductive contact 2 extends outwardly beyond corresponding vertical recess 172 of the insulative housing 1 and electrically connects with the printed circuit board. The first detective contact 31 and the second detective contact 32 is respectively fixed in the spaced slots 151 of the rear wall 13. The first finger 311 of the first detective contact 31 extending beyond the slot 151 partially touches with the second finger 321 of the second detective contact 32 extending beyond the slot 151. The soldering portion 33 of the detective contact 3 project beyond the slot 151 and solder with the printed circuit board. Finally, the locking portions 121 of the side walls 12 of the insulative housing 1 are fixed into corresponding holes (not shown) of the printed circuit board, thereby forming an integral electrical connection between the electrical card connector 100 and the printed circuit board.

In use, the electrical card 4 slides through the guiding chamfers 123 of the insulative housing 1 and is received in the receiving room 14. The electrical card 4 electrically connects with the contacting portions 22 of the conductive contacts 2 and abuts against the second detective contact 32 so that the second detective contact 32 departs from the first detective contact 31, thereby realizing the detective function. At the same time, the spring arm 1222 of the beam 122 of the side walls 12 abuts against the electrical card 4, thereby securely fixing the card 4 within the receiving room 14.

Comparing to prior arts, the electrical card connector 100 according to the present invention adopt the integrally molded insulative housing 1. The base member is disposed by a first projecting board 15 forwardly projecting from the rear wall 13 and a transverse support bar 16 spanning the front portions of the side walls 12, thereby decreasing the assembly process. In addition, the electrical card connector 100 employs a pair of resilient beams 122 integrally extending from the side walls 12 for elastically abutting against the electrical card 4, thereby securely retaining the electrical card 4 in the insulative housing 1 and improving the electronic capability of the electrical card connector 100. Furthermore, the base member may be disposed by a pair of support bars 16 spanning the side walls 12.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A card connector adapted for electrically connecting an electrical card with a printed circuit board comprising:

an insulative housing comprising a pair of side walls, a top wall, a rear wall and a base member, a plurality of passageways being defined in the base member, a pair of beams interiorly extending from the side walls for retaining the electrical card in the housing; and a plurality of contacts each comprising a main body received in said passageway, a contacting portion extending from an end of the main body and a soldering portion extending from another end of the main body for electrically connecting the printed circuit board;

wherein each beam includes a post joined with a corresponding side wall and a spring arm extending from the post and slanting upwardly toward the top wall, the post being adjacent to the bar and the spring arm being adjacent to the projecting board.

2. The card connector according to claim 1, wherein said base member includes a projecting board extending from the rear wall and a bar spanning the side walls of the housing.

3. The card connector according to claim 1, wherein said insulative housing includes guiding chamfers defined in the top wall and the base member for guiding insertion of the electrical card.

4. The card connector according to claim 1, wherein each passageway of the insulative housing includes a transverse channel and a vertical recess in communication with the transverse channel, and wherein each contact includes a pair of tabs downwardly extending from opposite sides of the main body for engaging with the transverse channel and a barb transversely extending from the soldering portion thereof for securely engaging with the vertical recess.

5. The card connector according to claim 1, further including a pair of detective contacts, and wherein said rear wall defines a pair of slots for fixing the detective contacts.

6. The card connector according to claim 5, wherein the detective contacts include a first detective contact having a first finger and a second detective contact having a second finger.

7. A card connector comprising:

a unitary plastic housing defining a top wall and a bottom not only opposite to each other in a vertical direction but also offset from each other in a lengthwise direction, perpendicular to said vertical direction, for injection molding consideration;

a pair of side walls extending along the lengthwise direction and spaced from each other in a lateral direction perpendicular to said lengthwise direction and said vertical direction, to connect said top wall and said bottom wall;

a receiving room formed between said top wall and said bottom wall in the vertical direction, and between the pair of side walls in said lateral direction;

a plurality of contacts disposed in the bottom wall with upper contacting portions extending upwardly into the receiving room for mechanical and electrical engagement with an electronic card inserted into the receiving room along said lengthwise direction;

wherein no portion of the top wall overlaps with any portion of the bottom wall in the vertical direction.

8. The card connector as claimed in claim 7, wherein said upper contacting portion also extends in said lengthwise direction and under said top wall vertically.

9. The card connector as claimed in claim 7, wherein a resilient arm integrally extends from the top wall in said lengthwise direction and downwardly into said receiving room for retaining said inserted card.

10. The card connector as claimed in claim 7, wherein said top wall defines an opening aligned, in the vertical direction, with a rear section of the bottom wall in which some of said terminals are disposed.

* * * * *